US005481786A

United States Patent [19]

Smith et al.

[11] Patent Number: 5,481,786

[45] Date of Patent: Jan. 9, 1996

[54] METHOD OF MANUFACTURING A RECYCLABLE CARPET

[75] Inventors: Charles W. Smith, Rutherforton, N.C.; Jimmy E. Millwood, Spartanburg, S.C.

[73] Assignee: Spartan Mills, Spartanburg, S.C.

[21] Appl. No.: 148,218

[22] Filed: Nov. 3, 1993

[51] Int. Cl.[6] ..... B32B 5/02

[52] U.S. Cl. ..... 28/107; 428/85; 28/111

[58] Field of Search ..... 28/107, 108, 109, 28/111, 112, 159; 428/085

[56] References Cited

U.S. PATENT DOCUMENTS

| | | | |
|---|---|---|---|
| 3,827,112 | 8/1974 | Betere | 28/111 |
| 3,925,866 | 12/1975 | Lochner | 28/111 |
| 4,131,704 | 12/1978 | Erickson et al. | 428/95 |
| 4,199,635 | 4/1980 | Parker | 28/111 X |
| 4,205,113 | 5/1980 | Hermansson et al. | 28/111 X |
| 4,242,389 | 12/1980 | Howell | 428/40 |
| 4,305,986 | 12/1981 | Hartmann et al. | 428/95 |
| 4,342,802 | 8/1982 | Pickens, Jr. et al. | 428/92 |
| 4,360,554 | 11/1982 | Campbell et al. | 428/91 |
| 4,389,442 | 6/1983 | Pickens, Jr. et al. | 428/92 |
| 4,390,582 | 6/1983 | Pickens, Jr. et al. | 428/85 |
| 4,391,866 | 7/1983 | Pickens, Jr. et al. | 428/92 |
| 4,416,936 | 11/1983 | Erickson et al. | 28/107 |
| 4,725,476 | 2/1988 | Mussallem, III | 428/167 |
| 5,031,289 | 7/1991 | Le Roy et al. | 28/107 |
| 5,114,787 | 5/1992 | Chaplin et al. | 428/284 |
| 5,216,790 | 6/1993 | Eschenbach | 28/112 |
| 5,239,734 | 8/1993 | Bathelier et al. | 28/107 |

OTHER PUBLICATIONS

Needle Punched Carpets with Pole and Texture–*Textile Manufacturer,* Oct. 1971, vol. 98 No. 1161 pp. 50–51.

*Primary Examiner*—John J. Calvert
*Attorney, Agent, or Firm*—Hardaway Law Firm

[57] ABSTRACT

A tufted fabric (1) devoid of external chemical binders is formed by crosslapping a carded web of fibers (10) onto a back side (15) of a tufted primary backing (12), the opposed front side (19) of which having tufts (17) projecting therethrough, while it is transported by a conveyor (46) feeding into a first needle loom (20). Fibers in the primary backing and in the carded web of fibers are then entangled by the first needle loom and by a second needle loom (36), whereby the carded web of fibers meshes with the primary backing to form a carpet backing (58) of sufficient weight and integrity to replace a conventional carpet underpad. The carpet backing is a blend of preferably homogenous fibers wherein the primary backing and the carded web of fibers are indistinguishable from one another. The tufted fabric may then be dyed and dried through a heat treatment, which, if the tufted fabric includes binder fibers, causes a fusion bond between the fibers in the carpet backing and between the carpet backing and the tufts.

11 Claims, 2 Drawing Sheets

METHOD OF MANUFACTURING A RECYCLABLE CARPET

BACKGROUND OF THE INVENTION

This invention relates generally to a method of manufacturing a carpet of one or more fibers and devoid of external chemical binders, the carpet preferably being constructed of a single material which is recyclable.

It has been found desirable to manufacture a recyclable carpet without using external chemical binders, such as latex, to bind fabric layers together in a carpet structure. The term "external" as used herein describes any chemical binder other than binder fibers which may be present in tufts or in one or more backings.

Entanglement of two pre-formed layers to construct a recyclable carpet is well known in the art. For instance, U.S. patent application Ser. No. 08/041,601, pending at time of filing hereof, teaches a recyclable carpet wherein a pre-formed secondary backing is attached to the back side of a pre-formed tufted primary backing by either needle entanglement or fusion bonding, both backings being preferably non-wovens. U.S. Pat. No. 4,390,582 to Pickens, Jr. et al. discloses entanglement of a pre-formed carrier member to a needled batt, wherein tufting of the needled batt is executed subsequent to such entanglement.

Entanglement of a woven scrim to a non-woven material is also known, as taught by U.S. Pat. Nos. 4,360,554 and 4,725,476 to Campbell et al. and to Mussallem, III, respectively.

U.S. Pat. No. 5,114,787 to Chaplin et al. teaches a composite formed by attaching, such as by entanglement, a carded web of non-woven fibers to a self-bonded non-woven web. The self-bonded non-woven web is formed by extruding a molten polymer, quenching the molten polymer to form filaments, drawing the filaments into fibers, and collecting the drawn fibers, where the fibers bond to each other in a collection device. However, since the disclosed composite is directed principally to diapers and other such hygienic products, the self-bonded non-woven web is not taught to be tufted prior to being attached to the carded web of non-woven fibers.. Furthermore, there is no disclosure of any effect of the attachment step upon the properties of the carded web of non-woven fibers.

SUMMARY OF THE INVENTION

It is an important object of the present invention to provide a method of manufacturing a carpet without external chemical binders.

It is a further object of the present invention to eliminate the necessity to produce a pre-formed secondary backing prior to joining thereof with a tufted primary backing.

It is a further object of the present invention to provide a method of manufacturing a carpet without external chemical binders wherein attachment of a carded web of fibers to a primary backing forms a continuous homogenous fabric such that the carded web and the primary backing become indistinguishable from one another.

It is a further object of the present invention to reduce the processing steps associated with manufacture of a carpet devoid of external chemical binders.

These as well as other objects are accomplished by a method of manufacturing a carpet without external chemical binders, comprising the steps of forming a fibrous tufted primary backing having a front side through which tufts project and a back side, forming a carded web of fibers separate from the fibrous tufted primary backing, crosslapping the carded web of fibers onto the back side of the fibrous tufted primary backing to form an intermediate composite, and attaching fibers in said fibrous tufted primary backing to fibers in said carded web of fibers, said attaching causing said carded web of fibers to mesh with said primary backing to form a carpet backing, whereby the carpet backing and the tufts form an assembled tufted fabric.

DETAILED DESCRIPTION

In accordance with this invention, it has been found that a method of manufacturing a carpet without external chemical binders may be provided which eliminates the necessity to produce a pre-formed secondary backing prior to joining thereof with a tufted primary backing. Various other advantages and features will become apparent from a reading of the following description given with reference to the various figures of drawings.

Figure 1:
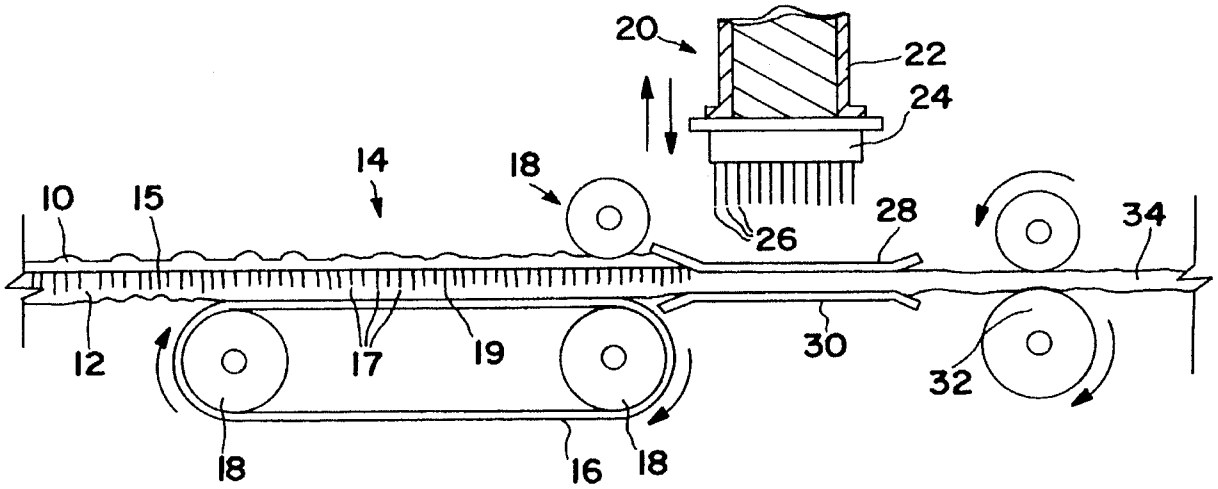
FIG. 1 is a side elevation view of a portion of the apparatus used in performing the process of the present invention, shown in association with a carded web of fibers superposed onto a tufted primary backing.

Referring to FIG. 1, a carded web of fibers 10 is shown superposed onto a fibrous pre-formed, primary backing 12 having a back side 15 and tufts 17 protruding from a front side 19.

Tufted primary backing 12 is formed by first providing a fibrous primary backing web, preferably comprised of a non-woven fabric normally 2 to 24 oz./yd$^2$ but preferably 4 to 8 oz./yd$^2$. The non-woven fabric is comprised of polyester or other thermoplastic fibers. The denier of the fiber in the primary backing 12 will generally be from about 1 to about 21 dpf. The primary backing web is needled on one or both sides with a total of typically 200–2000 penetrations per square inch and can be heat set for stability. A wide variety of needle types and stroke rates may be used to produce a fabric of proper strength and uniformity. Next, tufts such as at 17 are driven through the fibrous primary backing web in a normal manner by a tufting machine. The fibers in the tufts 17 are entangled with fibers in the fibrous primary backing web to anchor the tufts 17 therein. The primary backing 12 takes the place of standard woven or spunbond polypropylene and a latex adhesive.

Figure 2:
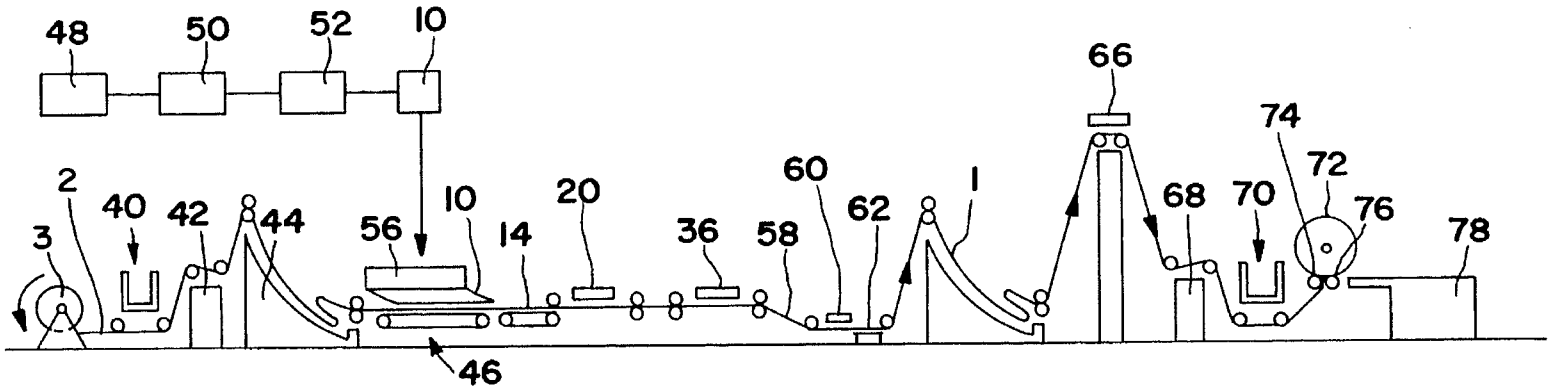
FIG. 2 is a side elevation view of additional machinery used in the process of the present invention, with the formation of a carded web of fibers shown in schematic.

The tufted primary backing 12 and the carded web of fibers 10 form an intermediate composite, generally indicated at 14, which is fed by an endless conveyor belt 16 driven by feed rollers 18 into a first needle loom 20 having a beam 22 carrying a board 24 of needles 26. The intermediate composite 14 passes between upper and lower plates 28 and 30, respectively, as it is positioned beneath the needles 26. Beam 22 is driven upwardly and downwardly in repeated cycles such that needles 26 engage the intermediate composite 14 to entangle fibers in the primary backing 12 and in tufts 17 with fibers from the carded web 10. Once a number of cycles has been executed to effectively entangle the carded web 10 and the tufted primary backing 12, delivery rollers such as at 32 move the needled composite 34 to a subsequent process station, which may be a second needle loom 36 (FIG. 2). After needle entanglement treatment, the carded web 10 and primary backing 12 form a homogeneous, continuous blend of fibers where they are indistinguishable from one another.

Figure 3:
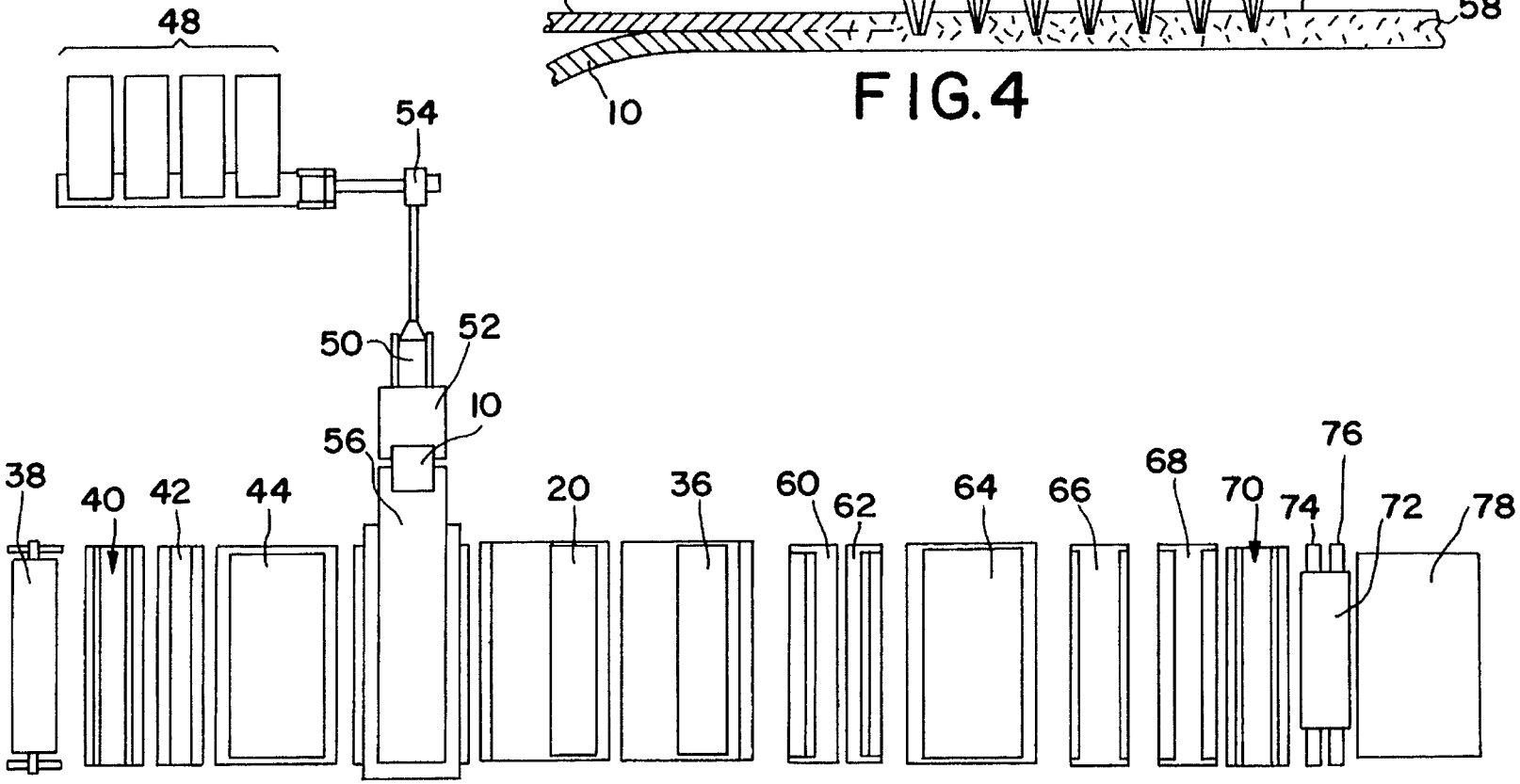
FIG. 3 is a plan view of the machinery illustrated in FIG. 2.

FIGS. 2 & 3 illustrate the entire series of steps involved in the sequential stages of manufacture of a carpet without external chemical binders. The pre-formed, tufted primary backing 12 is dispensed from a supply roller 38 upon which it is stored, conveyed past a first inspection station 40 and a carpet seamer 42, into a first accumulator 44, and onto a conveyor belt 46 such that the back side 15 (FIG. 1) of primary backing 12 is pointed upwardly. Meanwhile, fiber blending, feeding, and carding systems, schematically represented at 48, 50, and 52, respectively, produce carded web of fibers 10. Fiber transporting system 54 transports blended fibers into the fiber feeding system 50, as shown in FIG. 3. Carded web 10 passes from the fiber carding system 52 into a crosslapping machine 56, which superposes the web 10 onto the back side 15 of primary backing 12 at conveyor belt 46. Crosslapping machine 56 traverses at an angle to the line of travel of primary backing 12 on the conveyor belt 46, such that web 10 straightens and extends at an angle to the line of travel as it travels on primary backing 12 along conveyor belt 46.

Figure 4:
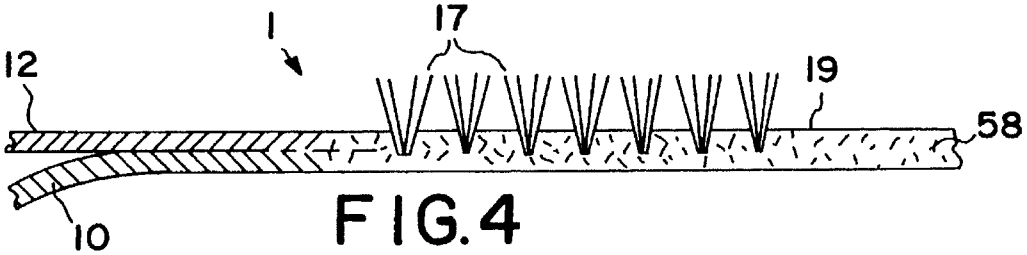
FIG. 4 is a side elevation view of a tufted primary backing and a carded web of fibers progressing into a homogenous blend of fibers to form a carpet constructed in accordance with the process of the present invention.

The intermediate composite 14 is fed into first needle loom 20 in the manner previously described, and then preferably to second needle loom 36, although use of a single needle loom is considered as being within the scope of the present invention. Through needle entanglement, carded web 10 becomes meshed with primary backing 12 to form a carpet backing 58 (FIG. 4). In this regard, carpet backing 58 may be of sufficient weight and integrity to replace a conventional carpet underpad. Together with the tufts 17, carpet backing 58 forms an assembled tufted fabric 1 (FIG. 4).

Tufted fabric 1 exists an outlet side of second needle loom 36 and passes between first and second needle removers, such as magnets 60 and 62, respectively, which remove any needles caught in tufted fabric 1 that may have broken off from a needle board in either needle loom. Tufted fabric 1 is then collected on a second accumulator 64, whereafter it is fed past a needle detector 66 signaling presence of any remaining needles not removed by needle removers 60 & 62, a winder station 68, and a second inspection station 70. The tufted fabric 1 emerging from the second inspection station 70 is taken up by roll 72 driven by drive rollers 74 and 76. Roll doffing table 78 accommodates a fully-wound roll preparatory to further transport thereof.

Although the foregoing description of the manufacturing process details needle punching of the carded web of fibers 10 and the primary backing 12 to one another, it is understood that these components can alternatively be thermally bonded to one another. Both the cardeld web 10 and the primary backing 12 may include binder fibers, such as a polyester polymer having a lower melting point than the non-binder fibers, which melt under heat to form fusion bonds between one another. A preferred binder fiber is composed of polyethylene terephthalate/isophthalate having a isophthalate/terephthalate mol ratio of about 20% to 40%, which has melting temperatures of about 110° C. to 200° C.

Referring to FIG. 4, the assembled tufted fabric 1 is comprised of the carpet backing 58 and the tufts 17 protruding through front side 19 thereof. The carpet backing 58 is shown to be the result of the blending of carded web of fibers 10 and primary backing 12 to one another. The carded web of fibers 10 provides further anchoring of the tufts 17 in addition to that provided by entanglement of tuft fibers and fibers in the primary backing 12. Furthermore, the carded web of fibers 10 is so blended to the primary backing 12 such that the carded web of fibers 10 and primary kacking 12 become indistinguishable from one another. The tufted fabric 1 is thus a homogenous blend of fibers.

The process of the present invention may include the further step of dyeing the tufted fabric 1 after it has been assembled. Although the carpet backing 58 and the tufts 17 can be dyed one color, they can also be dyed in multiple colors or be subject to printing. After dyeing, the tufted fabric 1 is dried by being subjected to a heat treatment. If the tufted fabric 1 includes a binder fiber of the type discussed above, the heat treatment enhances the bonding of the tufts 17 to the carpet backing 58, as well as fibers within the carpet backing 58 to one another, by causing the binder fibers to melt, thereby forming fusion bonds between one another.

Fibers contained in the carded web of fibers 10, the primary backing 12, and in the tufts 17 may all be selected from a group consisting of polyamide fibers, polyester, polypropylene, and polyethylene terephthalate. The tufted fabric 1 is preferably comprised of one type of fibers, such as polyester, but may consist of different fibers such as nylon or polypropylene tufts, a polyester primary backing and a polyester web of fibers. Preferably, the tufted fabric 1 would entirely consist of polyester fibers, in particular, polyethylene terephthalate (PET) fibers, PET being commercially available at a relatively low cost. The polyester may include a phosphorous containing units to provide flame retardancy.

The tufts 17 may be made of any suitable recyclable fiber, such as polyester, PET, polypropylene, or nylon. The PET may include up to 50% of a comonomer such as polyethylene glycol, diethylene glycol, adipic acid, isophthalic acid and modifiers normally used to provide cationic or carrierless dyeability to the PET.

The tufted fabric 1 may comprise residential, contract, commercial, walk-off, automotive, and rug carpets and bath mats of all standard constructions including cut pile, loop pile, saxony, and textured, and from virtually any type of carpet fiber.

Regardless of whether the carded web of fibers 10 and the primary backing 12 is comprised of identical material, it is crucial that the finished product be devoid of external chemical binders. The presence of such chemical binders in a carpet construction has been known to create problems in the maintenance and disposal of the carpet. For instance, latex in a bathroom rug seriously degrades upon washing and drying. Furthermore, latex makes recycling of a carpet impossible. The carpet constructed of a single material in accordance with the method of the present invention facilitates recycling thereof and eliminates the foregoing problems.

The process of the present invention can be used with any thermoplastic material that is recyclable, i.e., it could be used to make a recyclable nylon or polypropylene as well as polyester as long as all the polymer in the carpet is the same type. Carpets constructed according to the process of the present invention may be recycled in various methods well known in the art. In particular, polyester carpet may be recycled by methods including, but not limited to: (1) grinding, pelletizing, drying, and extruding the pellets into polyester fiber; (2) regenerating the polyester by grinding glycolysis and batch polymerization; and (3) grinding, glycolysis, and methanolysis to break the monomer down into primary DMT and glycol, the base raw materials which can then be reused to make polyester. It will be apparent to those in the art areas that the specific recycling process is determined by the type of polymer used.

It is therefore seen that a carpet devoid of external chemical binders may be produced which eliminates the necessity of forming a completed secondary backing prior to entanglement thereof with a tufted primary backing. Attendant costs of production are thereby also eliminated, and the manufacturing process is simplified. Initially applying a carded web, as opposed to a pre-formed secondary backing, to a primary backing prior to needle entanglement of both layers saves a step in the manufacturing process.

As the above description is merely exemplary in nature, being merely illustrative of the invention, many variations will become apparent to those of skill in the art. Such variations, however, are included within the spirit and scope of this invention as defined by the following appended claims.

That which is claimed:

1. A method of manufacturing a carpet without external chemical binders, comprising the steps of:

forming a fibrous tufted primary backing having a front side through which tufts project and a back side;

forming a carded web of fibers separate from said fibrous tufted primary backing;

said carded web being free from further processing;

superposing said carded web of fibers onto said back side of said fibrous tufted primary backing to form an intermediate composite; and attaching fibers in said fibrous tufted primary backing to fibers in said carded web of fibers, said attaching causing said carded web of fibers to mesh with said primary backing to form a carpet backing;

whereby said carpet backing and said tufts form an assembled tufted fabric.

2. The method set forth in claim 1 wherein said attaching of fibers in said tufted primary backing to fibers in said carded web of fibers is accomplished by needle punching.

3. The method set forth in claim 2 wherein said intermediate composite is passed between an upper plate and a lower plate while undergoing needle punching.

4. The method set forth in claim 2 wherein said needle punching is performed by one or more needle looms.

5. The method set forth in claim 4 wherein said superposing takes place on a conveyor feeding into a needle loom.

6. The method set forth in claim 1 wherein said carded web of fibers and said tufted primary backing are formed of thermoplastic fibers.

7. The method set forth in claim 6 wherein said thermoplastic fibers are selected from a group consisting of polyamide, polyester, polypropylene, and polyethylene terephthalate.

8. The method set forth in claim 1 wherein said carded web of fibers and said tufted primary backing include binder fibers.

9. The method set forth in claim 8 wherein said attachment of fibers in said tufted primary backing to fibers in said carded web of fibers is accomplished by fusion bonding.

10. The method set forth in claim 9 comprising the further steps of:

dyeing said assembled tufted fabric; and drying said assembled tufted fabric by subjecting it to a heat treatment;

whereby heat from said heat treatment melts said binder fibers to form a fusion bond between fibers in said carpet backing and between said carpet backing and said tufts.

11. The method set forth in claim 1 wherein said fibers in said fibrous tufted primary backing and said fibers in said carded web of fibers are constructed of identical material, whereby said assembled tufted fabric is comprised of a homogenous blend of fibers.

* * * * *